US005983600A

United States Patent [19]

Heide et al.

[11] Patent Number: 5,983,600

[45] Date of Patent: Nov. 16, 1999

[54] METHOD OF AND APPARATUS FOR WEAKENING SELECTED PORTIONS OF ADHESIVE-COATED LABELS AND THE LIKE

[75] Inventors: Jirko Heide, Schwarzenbek; Eric Juergens, Hamburg, both of Germany

[73] Assignee: Topack Verpackungstechnik GmbH, Schwarzenbek, Germany

[21] Appl. No.: 09/100,113

[22] Filed: Jun. 19, 1998

[30] Foreign Application Priority Data

Jun. 21, 1997 [DE] Germany ..... 197 26 376

[51] Int. Cl.[6] ..... B65B 61/00; B65C 9/00

[52] U.S. Cl. ..... 53/415; 53/136.4; 156/DIG. 4; 493/356; 493/375; 493/911

[58] Field of Search ..... 53/415, 136.4, 53/136.3, 136.1, 135.1; 493/375, 379, 363, 356, 344, 911; 229/123.3, 123.2, 225; 156/DIG. 4, 3

[56] References Cited

U.S. PATENT DOCUMENTS

| | | | |
|---|---|---|---|
| 2,316,054 | 4/1943 | Davis et al. . | |
| 2,810,329 | 10/1957 | Schmidt et al. . | |
| 3,113,903 | 12/1963 | Harris et al. | 53/136.3 X |
| 3,266,709 | 8/1966 | Whitaker et al. . | |
| 3,374,603 | 3/1968 | Miller et al. | 53/136.4 X |
| 4,085,569 | 4/1978 | Seragnoli | 493/911 X |
| 4,086,744 | 5/1978 | Seragnoli | 53/136.4 |
| 4,524,658 | 6/1985 | Focke et al. | 83/152 |
| 4,875,325 | 10/1989 | Gamberini et al. | 53/136.3 |
| 5,111,633 | 5/1992 | Draghetti | 53/136.4 X |
| 5,192,262 | 3/1993 | Amendola et al. | 493/365 |
| 5,671,589 | 9/1997 | Irvine et al. | 53/133.8 X |

FOREIGN PATENT DOCUMENTS

| | | |
|---|---|---|
| 0395249 | 10/1990 | European Pat. Off. . |
| 1896434 | 4/1964 | Germany . |
| 2511341 | 11/1975 | Germany . |
| 2451993 | 5/1976 | Germany . |
| 2708897 | 9/1978 | Germany . |
| 3029292 | 2/1981 | Germany . |
| 3241636 | 5/1984 | Germany . |
| 3118774A1 | 10/1985 | Germany . |
| 4133404 | 4/1993 | Germany . |
| 4243928 | 7/1993 | Germany . |
| 19616871 | 10/1997 | Germany . |
| 19630690A1 | 2/1998 | Germany . |
| 2157260 | 10/1985 | United Kingdom . |

*Primary Examiner*—James F. Coan
*Attorney, Agent, or Firm*—Venable; George H. Spencer; Ashley J. Wells

[57] ABSTRACT

A label (e.g., a revenue stamp) for the application to a closed and filled hinged-lid packet for cigarettes or the like has a first part provided with an elongated weakened portion which is to overlie the abutting sloping edges of one lateral wall of the main section and the corresponding lateral panel of the lid in the closed position of the lid, and a second part overlying portions of the rear wall of the main section and of the rear panel of the lid at opposite sides of the elongated transversely extending hinge which pivotally connects the rear panel to the rear wall. The weakened portion is formed by a perforating, scoring, piercing, material removing or other suitable implement which is adjustably mounted on a support adjacent to an arcuate path for a succession of labels at the periphery of a rotary conveyor. One side of each label is coated with an adhesive subsequent to weakening and preparatory to attachment to a hinged-lid packet.

20 Claims, 4 Drawing Sheets

METHOD OF AND APPARATUS FOR WEAKENING SELECTED PORTIONS OF ADHESIVE-COATED LABELS AND THE LIKE

CROSS REFERENCE TO RELATED APPLICATION

This application claims the priority of Application No. 197 26 376.3 filed in Germany on Jun. 21, 1997, the subject matter of which is incorporated herein by reference.

BACKGROUND OF THE INVENTION

The invention relates to improvements in methods of and apparatus for manipulating labels (such as revenue stamps) prior to the application to containers of the type known as hinged-lid packets. Such containers are utilized by numerous manufacturers for the confinement of arrays of plain or filter cigarettes or other types of rod-shaped smokers' products. As a rule, the products are draped into an inner envelope of metallic or plastic foil, and the thus obtained block-shaped commodities are confined in hinged-lid packets. A filled packet is thereupon sealed as a result of confinement in a normally transparent outer envelope of cellophane or the like. It is further customary to apply a label to selected pairs of coplanar portions of the main section and the lid of a packet prior to confinement in the outer envelope.

The main section of a hinged-lid packet (which is normally made of strong paper or lightweight cardboard) comprises a bottom wall, a rear wall, a front wall and two trapezoid lateral walls. The lid includes a rear panel which is pivotally connected to the rear wall of the main section by an elongated transversely extending hinge (such as a weakened (e.g., creased) elongated straight portion of a blank which has been converted into a packet), a top panel, a front panel and two trapezoid lateral panels which are coplanar with and have sloping edges abutting the adjacent complementary sloping edges of the respective lateral walls of the main section when the lid is closed.

A first part of the label is glued to portions of the rear wall and the rear panel so that it overlies at least a portion of the hinge, and a second part of the label is glued to a portion of one lateral wall and to a portion of the respective lateral panel so that an elongated portion of the second part overlies at least a portion of each of the neighboring sloping edges on the one lateral wall and the respective lateral panel in the closed position of the lid. When a purchaser desires to gain access to the contents of a packet, such person must remove the transparent outer envelope and thereupon pivots the lid to open position. This results in partial destruction of the label because the label tears along the elongated portion which overlies the aforementioned sloping edges in the closed position of the lid.

It is desirable to weaken a label along the aforementioned elongated portion of the second part. Such weakening reduces the tensile strength of the label in the region of the elongated portion to thus ensure that the very first pivoting of the lid to open position does not necessitate the exertion of a pronounced force. Secondly, the appearance of a packet subsequent to initial pivoting of the lid to the open position is more pleasing to the eye if the second part of the label is torn along the predetermined (weakened) elongated portion.

Heretofore known proposals to weaken selected portions of the labels are not entirely satisfactory, not only because the weakening must be carried out by resorting to rather complex apparatus but also because the weakening takes up substantial amounts of time and is not always sufficiently accurate and/or pronounced to ensure predictable tearing of an applied label only in the region where the label must break in order to afford access to the contents of a packet confining a group of plain or filter cigarettes or the like.

OBJECTS OF THE INVENTION

An object of the invention is to provide a novel and improved method of weakening selected portions of labels in a highly predictable and reproducible manner and with a high degree of accuracy.

Another object of the invention is to provide a method which can be carried out in conjunction with one or more additional treatments of labels so that it is not necessary to predictably mount and/or otherwise prepare (e.g., convey) a label for the sole purpose of weakening a selected portion prior to attachment of the label to a packet while the lid is maintained in the closed position.

A further object of the invention is to provide a method which can be practiced in a highly satisfactory manner regardless of the exact configuration and/or exact size of the labels or analogous commodities.

An additional object of the invention is to provide a method which renders it possible to select the extent and/or the locus of predictably weakening a label within a wide range and with little loss in time.

Still another object of the invention is to provide a novel and improved apparatus for the practice of the above outlined method.

A further object of the invention is to provide an apparatus which can be associated with or incorporated into existing machines for the making, filling and sealing of hinged-lid packets for smokers' products and the like.

Another object of the invention is to provide an apparatus which is designed to subject a series of rapidly advancing blanks of paper or the like to a series of successive treatments including a treatment which involves a predictable weakening of selected portions of the blanks in accordance with the above outlined method.

An additional object of the invention is to provide a packet forming, filling and sealing machine which embodies the above outlined apparatus for weakening selected portions of labels or analogous commodities of paper, plastic sheet material or the like.

Still another object of the invention is to provide a simple, compact and inexpensive apparatus which can be readily adjusted for the purpose of changing the loci of weakened portions of labels or like objects which are to be attached (e.g., by means of a suitable adhesive substance) to selected portions of hinged-lid packets for arrays of rod-shaped smokers' products or the like.

A further object of the invention is to provide an apparatus which can be readily adjusted to select the nature and/or the extent of reducing the tensile strength of a series of rapidly advancing labels or like commodities in a machine for the making, filling and sealing of hinged-lid packets.

Another object of the invention is to provide a novel and improved combination of conveying and weakening means in an apparatus of the above outlined character.

SUMMARY OF THE INVENTION

One feature of the present invention resides in the provision of a method of weakening an elongated portion of a flexible label which is to be applied to a packet composed of (a) a main section including a rear wall and a trapezoid lateral wall extending at right angles to the rear wall, and (b) a lid which is pivotable relative to the main section between open and closed positions. The lid comprises a rear panel which is connected to the rear wall of the main section by an elongated hinge and is coplanar with the rear wall of the main section in the closed position of the lid. The lid further comprises a trapezoid lateral panel which is coplanar with and adjacent the lateral wall of the main section in the closed position of the lid. The lateral wall and the lateral panel have sloping elongated edges which are adjacent each other in the closed position of the lid. The application of the label to the packet is such that a first part of the applied label overlies portions of the rear wall and rear panel as well as at least a portion of the hinge, and that a second part of the applied label overlies portions of the lateral wall and lateral panel and that the weakened portion overlies at least a portion of each of the neighboring edges in the closed position of the lid. The improved method comprises the steps of advancing the label in a predetermined direction along a predetermined path, and weakening the elongated portion of the label in the course of the advancing step.

The weakening step preferably includes contacting the advancing label with a suitable tool. For example, the weakening step can comprise at least one of the treatments including cutting, piercing, scratching, scribing, scoring notching, perforating, slitting and material removing.

The advancing step can include moving the label along an arcuate path by a rotary conveyor and pneumatically attracting the label to the rotary conveyor.

If the weakening step includes contacting the advancing label with a tool (such as, for example, a perforating implement), the method can further comprise the step of adjusting the position of the conveyor relative to the implement and/or vice versa to thus effect at least one of (a) a change of the extent of weakening of the elongated portion of the label and (b) a change of the position of the elongated portion on the label.

The method can further comprise the step of coating one side of the label with a suitable adhesive, e.g., upon completion of the weakening step. Such method can further comprise the step of attaching the adhesive-coated label to a closed packet so that the weakened elongated portion of such label at least partially overlies the elongated edges of the lateral wall and the lateral panel of the main section and the lid of such packet.

For example, the label can constitute a revenue stamp or it can contain a trademark and/or the name of the manufacturer of the contents of the packet.

As already pointed out hereinabove, the method can comprise one or more steps in addition to the advancing and weakening steps; for example, such additional step(s) can include at least one treatment (e.g., coating with an adhesive) while the label advances along the predetermined path.

The weakening step preferably includes reducing the tensile strength of the elongated portion of the label to such an extent that the label tears or breaks only along the weakened portion during a first (initial) pivoting of the lid to its open position.

The novel apparatus comprises means for advancing the label in a predetermined direction along a predetermined path, and means for weakening the elongated portion of the advancing label in the predetermined path.

The means for weakening can comprise means for subjecting the elongated portion of the advancing label to at least one of a plurality of different treatments such as, for example, cutting, piercing, scratching, scribing, notching, slitting, perforating, other material removing, and so on.

The means for weakening can comprise at least one tool, e.g., a rotary tool. Such apparatus can further comprise means for supporting the at least one tool in a position of contact with the label in the predetermined path but out of actual contact with the advancing means.

The advancing means can comprise a rotary conveyor having a peripheral surface and means for pneumatically attracting the label to the peripheral surface of such conveyor. The means for attracting can include suction ports in the peripheral surface of the conveyor.

As already mentioned above, the means for weakening can comprise at least one tool, such as a perforating or scoring or creasing implement. Such apparatus can further comprise a support for the tool and means for adjustably securing the tool to the support adjacent a portion of the predetermined path. For example, the support can include a rotary shaft. The securing means can comprise means for releasably holding the at least one tool in any one of a plurality of different positions relative to the advancing means to thus select any one of a plurality of different weakened portions to be provided on the label in the predetermined path.

The advancing means can comprise a rotary drum-shaped conveyor which is arranged to advance a series of equidistant labels along the predetermined path and past the weakening means. A peripheral surface of such drum-shaped conveyor can be provided with a plurality of label-supporting platforms which are spaced apart from each other in a circumferential direction of the peripheral surface.

The novel features which are considered as characteristic of the invention are set forth in particular in the appended claims. The improved apparatus itself, however, both as to its construction and the mode of utilizing and operating the same, together with numerous additional advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
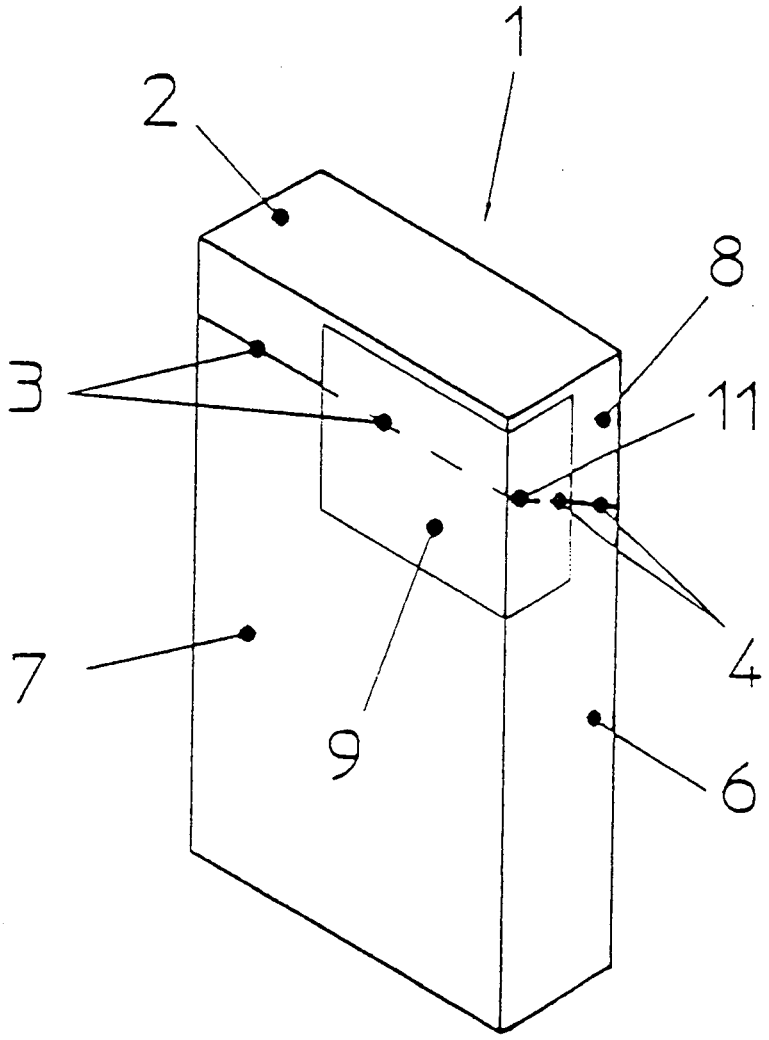
FIG. 1 is a perspective view of a hinged-lid packet with the lid in closed position and an intact label applied to selected walls of the main section of the packet as well as to selected panels of the lid.

FIG. 1 shows a hinged-lid packet 1 which is normally made of relatively stiff paper or lightweight cardboard and comprises a main section including a rear wall 7, two trapezoid lateral walls 6 (only one can be seen in FIG. 1), a bottom wall (not shown) and a front wall (not shown). The lateral wall 6 extends at right angles to the rear wall 7, and its width is a fraction of that of the rear wall. The lid 2 is shown in the closed position and is yieldably held in such closed position by a label 9 (e.g., a revenue stamp) which is weakened at 11 in the apparatus and in accordance with the method of the present invention.

The lid 2 comprises a rear panel (shown but not referenced) which is pivotably connected to the top portion of the rear wall 7 by an elongated transversely extending hinge 3 (such as a straight weakened portion of the converted blank which constitutes the packet 1), a top panel (not referenced), a front panel (not shown in FIG. 1), and two trapezoid lateral panels 8 (only one can be seen in FIG. 1) which are coplanar with the respective lateral walls 6. When the lid 2 is closed, the sloping lower edge of each lateral panel 8 abuts or is closely or immediately adjacent the equally sloping top edge of the respective lateral wall 6 (as at 4).

The label 9 which is shown in FIG. 1 is bonded to the main section as well as to the lid 2 of the packet 1 in the following way: A (normally major) first part of the label 9 overlies portions of the rear wall 7 of the main section and of the rear panel of the lid 2 so that it also overlies at least a portion of the hinge 3. The rear panel of the lid 2 is coplanar with the rear wall 7 of the main section of the packet 1 when the lid is maintained in the closed position of FIG. 1. A second part of the label 9 overlies a portion of the illustrated lateral wall 6 and a portion of the illustrated lateral panel 8, and this second part of the label has an elongated weakened portion 11 overlying at least a part of the region 4 where the sloping edges of the wall 6 and the panel 8 abut or are closely adjacent each other.

The label 9 must break (i.e., it must be torn) along the elongated portion 11 before the lid 2 can be pivoted to the open position in which it affords access to the contents of the packet 1, e.g., an array of twenty plain or filter cigarettes in a customary so-called quincunx formation wrapped into an (inner) envelope of metallic or plastic foil.

Figure 2:
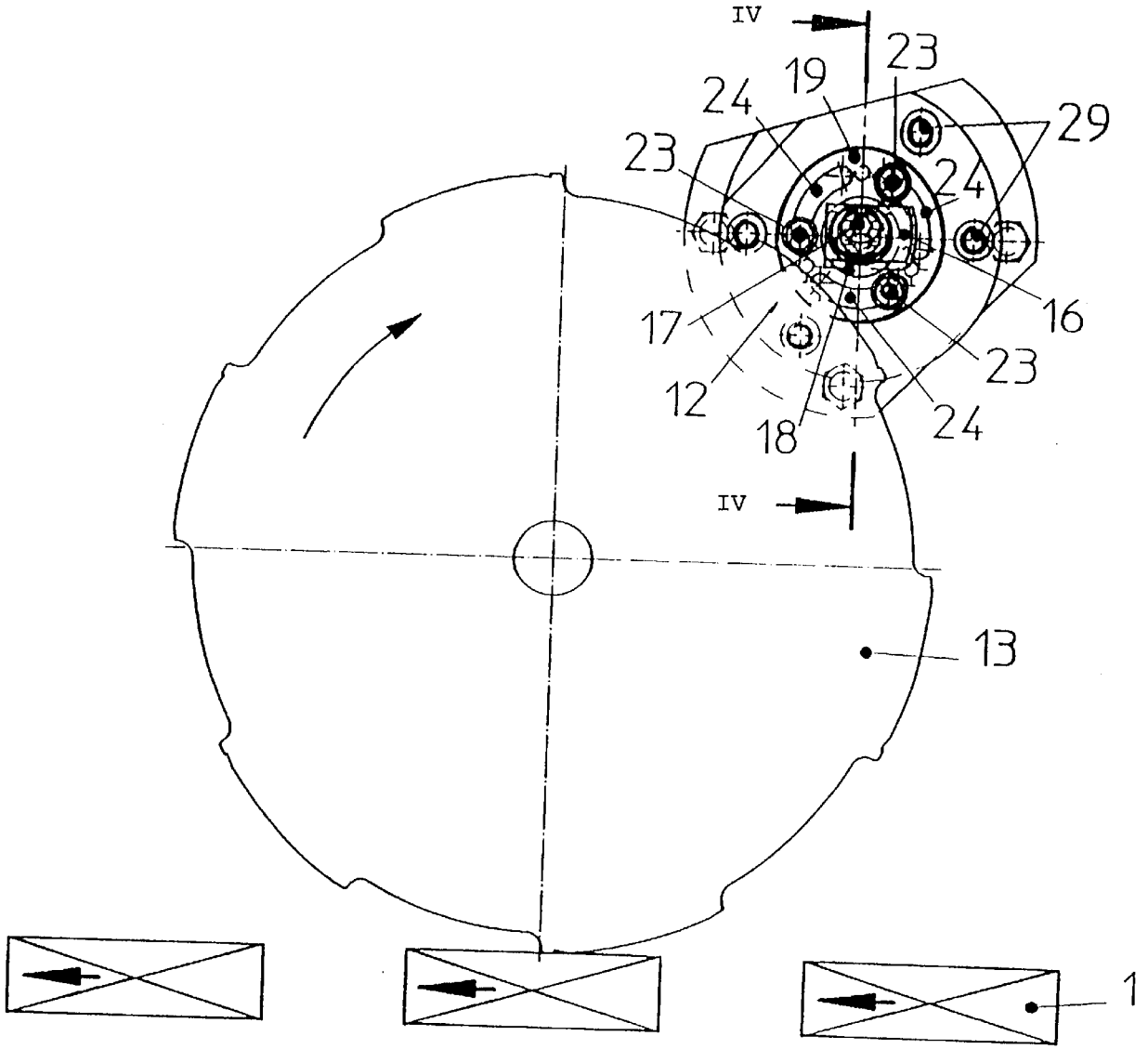
FIG. 2 is an elevational view of an apparatus which embodies a presently preferred form of the invention and can be utilized to weaken selected portions of labels in or downstream of a cigarette packing machine.
Figure 3:
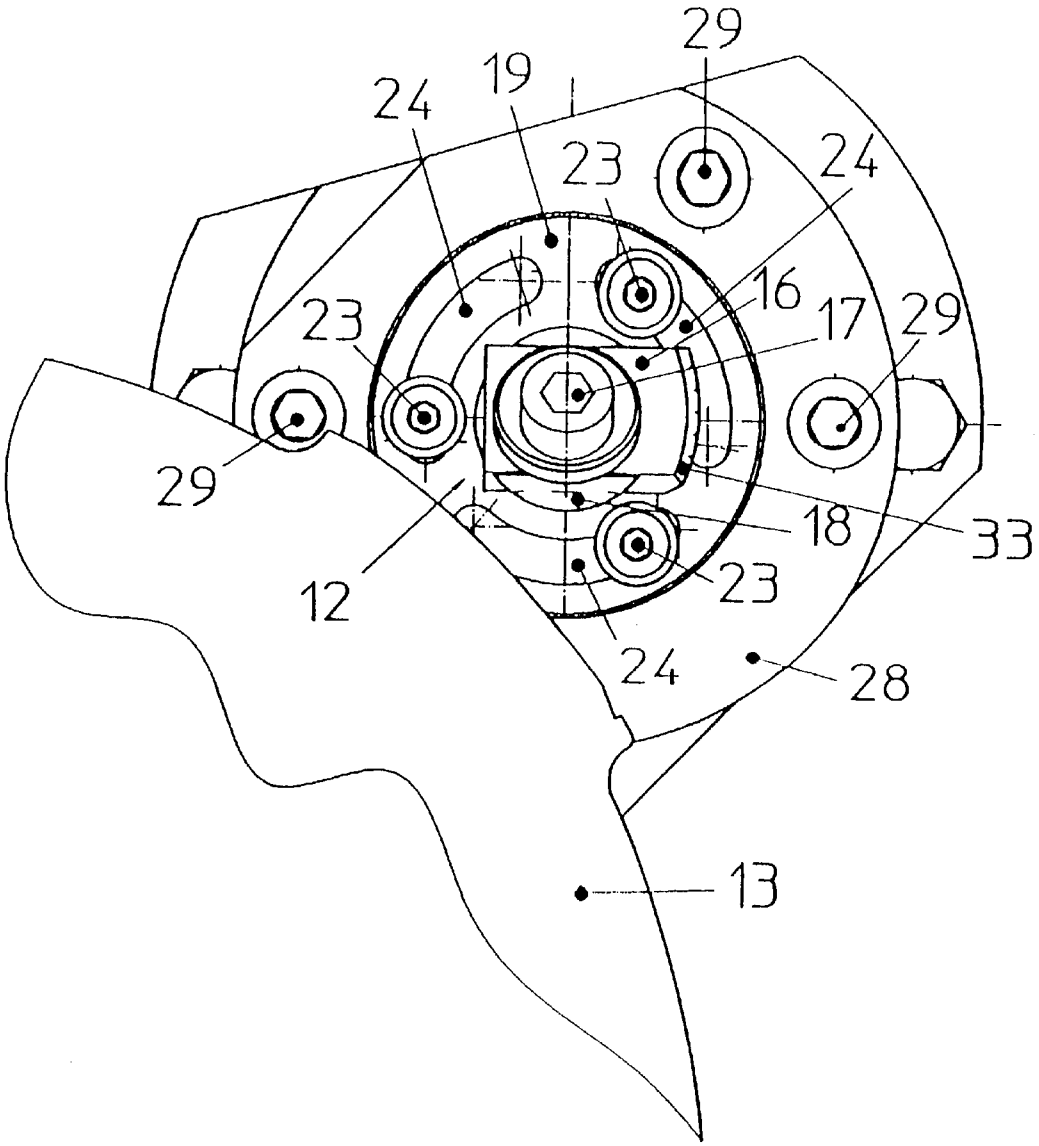
FIG. 3 is an enlarged view of a detail in the apparatus of FIG. 2.
Figure 4:
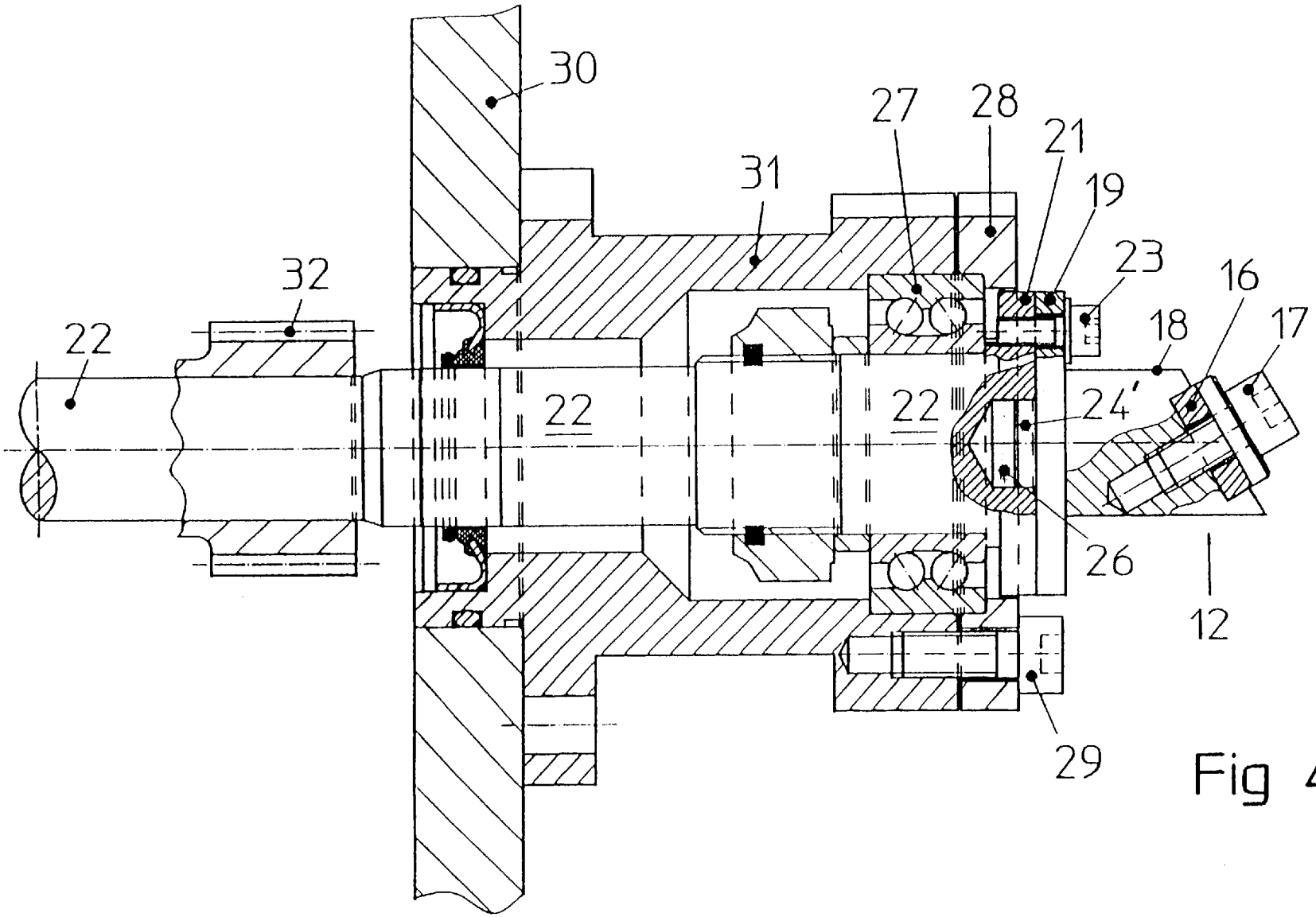
FIG. 4 is an enlarged sectional view substantially as seen in the direction of arrows from the line IV—IV in FIG. 2.

In accordance with the method of the present invention, the elongated weakened portion 11 is formed in an apparatus of the type shown in FIGS. 2 to 4 or in an analogous apparatus. The illustrated apparatus 12 includes a preferably exchangeable and preferably adjustable tool or implement which can subject a series of labels 9 to any one of a plurality of different treatments including perforating, creasing, scratching, scoring, slitting, piercing, cutting, material removing and/or many others. All that counts is to ensure that the tensile strength of a label 9 in the region of its elongated portion 11 is reduced to an extent which is necessary or desirable to guarantee that the initial pivoting of the lid to the open position results in a predictable tearing of the label along the weakened elongated portion 11. This renders it possible to pivot the lid 2 at 3 to an extent (e.g., through a little more than 90°) which is necessary to ensure convenient access to the inner envelope and to the cigarettes within such envelope.

The apparatus 12 which is shown in FIS. 2 to 4 comprises a rotary drum-shaped conveyor 13 serving as a means for advancing a succession of equidistant label blanks along an arcuate path and in a predetermined direction (clockwise, as viewed in FIG. 2). The peripheral surface of the conveyor 13 is provided with a set of equidistant platforms having suction ports (not specifically shown) forming part of means for pneumatically attracting the label blanks to the top lands of the respective platforms.

Successive blanks are fed into or located in the range of suction ports provided in the oncoming platforms of the conveyor 13 at a location upstream of an adjustable implement or tool 16 (e.g., a perforating tool) which is adjacent the path of movement of successive blanks and provides such blanks with elongated weakened portions 11, e.g., by providing the corresponding portions of the blanks with rows of perforations in a distribution and of a size sufficient to ensure adequate reduction of tensile strength so that, when properly applied to a packet 1, each of the thus obtained labels 9 reliably breaks or tears along such weakened portion 11 in response to the application of a force in a direction to pivot the lid 2 from the closed position (shown in FIG. 2).

Each perforated label which advances (clockwise, as viewed in FIG. 2 or 3) beyond the weakening (perforating) station for the tool 16 is coated with a film of a suitable adhesive and is thereupon applied to the oncoming pocket 1 (a row of such pockets can be seen in the lower part of FIG. 2). A rotary drum-shaped conveyor for labels and means for coating one side of each of a series of labels with a film of adhesive are described and shown in published German patent application No. A 41 33 404. The disclosure of this publication is incorporated herein by reference. This publication further shows the means for supplying labels to a rotary conveyor.

FIG. 3 shows the details of a presently preferred support for and a presently preferred adjustable mounting of the tool or implement 16 adjacent the path of advancement of successive label blanks past the perforating station. The tool 16 is mounted on a rotary shaft 22 (best shown in FIG. 4) which receives torque from a suitable prime mover (such as the prime mover of a cigarette packing machine) by way of a pinion 33. The shaft 22 supports a holder 18, and the tool 16 is adjustably affixed to the holder 18 by at least one threaded fastener 17. The holder 18 has a collar 19 which abuts a collar 21 at the adjacent end of the shaft 22. As can be seen in FIG. 3, the collar 19 has elongated arcuate slots 24 for the shanks of threaded fasteners 23 which extend into tapped bores of the flange 21 to thus maintain the holder 18 and the tool 16 in a selected position relative to the shaft 22 and the conveyor 13. The fasteners 23 can be loosened to permit angular adjustments of the holder 18 and tool 16 about the axis of the shaft 22.

The flange 19 of the tool holder 18 is further provided with a centrally located cylindrical stub 24' which extends through the flange 21 and into a centering socket 26 in the adjacent end portion of the shaft 22; this ensures that the flange 19 remains coaxial with the shaft 22 in each angular position of the holder 18.

That end portion of the shaft 22 which is adjacent the collar 19 is rotatably mounted in an antifriction ball bearing 27 installed in a stationary or adjustable housing 31 and held in a predetermined position by a cover 28 which is separably secured to the housing 31 by threaded fasteners 29. The housing 31 is secured to a wall 30 through which the shaft 22 extends.

The improved apparatus 12 renders it possible to adjust the position of the tool 16 relative to the label blanks on the conveyor 13 for the purpose of selecting the locations of the weakened portions 11. Furthermore, and if the illustrated perforating tool 16 is replaced with a different perforating tool or with a severing, creasing or other suitable tool, adjustments of the tool relative to the shaft 22 can also serve to select the intensity of the weakening action (e.g., by inserting one or more shims or washers between the flanges 19 and 21).

The position of the perforating portion 33 of the illustrated tool 16 relative to the peripheral surface of the conveyor 13 is or can be selected in such a way that the perforating portion 33 can come close to but does not actually contact the conveyor 13 during weakening of elongated portions 11 on successive label blanks being advanced toward the oncoming packets 1. This prolongs the useful life of the conveyor 13 as well as of the tool 16.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating labels or the like and, therefore, such adaptations should and are intended to be comprehended within the meaning and range of equivalence of the appended claims.

What is claimed is:

1. A method of weakening an elongated portion of a flexible label which is to be applied to a packet composed of (a) a main section including a rear wall and a trapezoid lateral wall extending at right angles to the rear wall, and (b) a lid pivotable relative to the main section between open and closed positions and including a rear panel connected to the rear wall by an elongated hinge and coplanar with the rear wall in the closed position of the lid, and a trapezoid lateral panel coplanar with and adjacent said lateral wall in the closed position of the lid, said lateral wall and said lateral panel having elongated edges which are adjacent each other in the closed position of the lid, the application of the label to the packet being such that a first part of the applied label overlies portions of the rear wall and rear panel and at least a portion of the hinge and a second part of the applied label overlies portions of the lateral wall and lateral panel and the weakened portion overlies at least a portion of each of said edges in the closed position of the lid, comprising the steps of advancing the label in a predetermined direction along a predetermined path; and weakening the elongated portion of the label in the course of said advancing step.

2. The method of claim 1, wherein said weakening step includes contacting the advancing label with a tool.

3. The method of claim 1, wherein said weakening step comprises at least one of the treatments including cutting, piercing, scratching, scribing, notching, perforating, slitting and material removing.

4. The method of claim 1, wherein said advancing step includes moving the label along an arcuate path by a rotary conveyor and pneumatically attracting the label to the rotary conveyor.

5. The method of claim 1, wherein said weakening step includes contacting the advancing label with an implement, and further comprising the step of adjusting the position of at least one of the conveyor and the implement relative to the other thereof to thus effect at least one of (a) a change of the extent of weakening of the elongated portion and (b) a change of the position of the elongated portion on the label.

6. The method of claim 1, further comprising the step of coating one side of the label with an adhesive upon completion of said weakening step.

7. The method of claim 6, further comprising the step of attaching the adhesive-coated label to a closed packet so that the weakened elongated portion at least partly overlies the elongated edges of the lateral wall and the lateral panel of such packet.

8. The method of claim 1, wherein the label is a revenue stamp.

9. The method of claim 1, further comprising the step of subjecting the label to at least one treatment in addition to weakening while the label advances along said path.

10. The method of claim 1, wherein said weakening step includes reducing the tensile strength of the elongated portion of the label to such an extent that the label tears only along the weakened portion during a first pivoting of the lid to open position.

11. Apparatus for weakening an elongated portion of a flexible label which is to be applied to a packet composed of (a) a main section including a rear wall and a trapezoid lateral wall extending at right angles to the rear wall, and (b) a lid pivotable relative to the main section between open and closed positions and including a rear panel connected to the rear wall by an elongated hinge and coplanar with the rear wall in the closed position of the lid, and a trapezoid lateral panel coplanar with and adjacent the lateral wall in the closed position of the lid, the lateral wall and the lateral panel having elongated edges which are adjacent each other in the closed position of the lid, the application of the label to the packet being such that a first part of the applied panel overlies portions of the rear wall and the rear panel and overlies at least a portion of the hinge and a second part of the applied label overlies the lateral panel and the lateral wall and the weakened portion of the label overlies at least a portion of each of the elongated edges in the closed position of the lid, comprising means for advancing the label in a predetermined direction along a predetermined path; and means for weakening the elongated portion of the advancing label in said path.

12. The apparatus of claim 11, wherein said means for weakening comprises means for subjecting the elongated portion of the advancing label to at least one of the treatments including cutting, piercing, scratching, scribing, notching, slitting, perforating and material removing.

13. The apparatus of claim 11, wherein said means for weakening comprises at least one tool.

14. The apparatus of claim 13, further comprising means for supporting said at least one tool in a position of contact with the label in said path but out of contact with said advancing means.

15. The apparatus of claim 11, wherein said advancing means comprises a rotary conveyor having a peripheral surface and means for pneumatically attracting the label to said peripheral surface.

16. The apparatus of claim 15, wherein said means for attracting includes suction ports in the peripheral surface of said conveyor.

17. The apparatus of claim 11, wherein said means for weakening comprises at least one tool, and further comprising a support for said tool and means for adjustably securing the tool to said support adjacent a portion of said path.

18. The apparatus of claim 17, wherein said securing means comprises means for releasably holding the at least one tool in any one of a plurality of different positions relative to said advancing means to thus select any one of a plurality of different weakened portions to be provided on the label in said path.

19. The apparatus of claim 11, wherein said advancing means comprises a rotary drum-shaped conveyor arranged to advance a succession of equidistant labels along said path and past said weakening means.

20. The apparatus of claim 19, wherein said conveyor has a peripheral surface provided with a plurality of label-suporting platforms spaced apart from each other in a circumferential direction of said peripheral surface.

* * * * *